United States Patent [19]

Taylor

[11] Patent Number: 4,616,444

[45] Date of Patent: Oct. 14, 1986

[54] RADIO CONTROLLED GATE OPENER

[76] Inventor: Daniel E. Taylor, Rte. 2, Box 30, Sundance, Wyo. 82729

[21] Appl. No.: 618,366

[22] Filed: Jun. 6, 1984

[51] Int. Cl.[4] ..... E05F 11/04

[52] U.S. Cl. ..... 49/347; 49/357; 49/387

[58] Field of Search ..... 49/347, 357, 387, 386, 49/340, 332, 274

[56] References Cited

U.S. PATENT DOCUMENTS

| | | | |
|---|---|---|---|
| 753,172 | 2/1904 | Skellenger | 49/387 X |
| 1,253,783 | 1/1918 | Castle | 49/332 |
| 1,448,480 | 3/1923 | Bedell | 49/347 X |
| 3,775,906 | 12/1973 | Dougherty | 49/358 |
| 3,988,860 | 11/1976 | Nevarez | 49/327 X |
| 4,381,626 | 5/1983 | Courtis et al. | 49/386 X |
| 4,416,085 | 11/1983 | Lybecker et al. | 49/340 |
| 4,475,310 | 10/1984 | Brewer | 49/387 X |

*Primary Examiner*—Philip C. Kannan

*Attorney, Agent, or Firm*—Harvey B. Jacobson

[57] ABSTRACT

A swinging gate is operated in one direction between open and closed positions by a winch and cable system driven by an electric motor which may be controlled remotely by radio, the winch and motor being carried on a support arm extending from a gatepost on one side of the gate. The gate is operated in the other direction by a falling weight connected to the gate by a cable extending around a pulley on a second support arm extending from the gatepost. The weight is raised when the gate is moved in the one direction by the winch and cable system and is held in raised position by the winch and cable while the gate remains in one of the open and closed positions. When the gate is to be moved in the other direction, the winch is released and the weight is allowed to fall. In a modification of the invention, the winch and cable system and weight are replaced by a reversible electrically operated linear actuator connected between the gate and a support arm extending from the gatepost.

15 Claims, 8 Drawing Figures

RADIO CONTROLLED GATE OPENER

BACKGROUND OF THE INVENTION

This invention relates to outdoor gates, particularly heavy-duty farm or ranch gates and the like. In farming, ranching, and other outdoor environments it is frequently desirable for a gate in a fence to have a capability of being operated remotely, for example, by a radio-transmitted signal. The present invention provides gate operating apparatus which lends itself to remote control by radio transmitter and the like, but if desired, can also be controlled by in situ switch means at the gate itself.

Statement of Prior Art

The following U.S. patents disclose various forms of gates and gate control apparatus. None of these, however, discloses the features of the present invention:

| | |
|---|---|
| 1,253,783 | Jan. 15, 1918 |
| 3,775,906 | Dec. 4, 1973 |
| 3,988,860 | Nov. 2, 1976 |
| 4,381,626 | May 3, 1983 |
| 4,416,085 | Nov. 22, 1983 |

SUMMARY OF THE INVENTION

The invention provides electrically controlled gate operating apparatus which may be employed in a multiplicity of applications to provide economical yet reliable means for opening and closing farm or ranch gates and the like from remote locations, or from a position at the gate itself. The apparatus is preferably applied to swinging-type gates rather than sliding-type gates, since the former are considered more suitable to farming and ranching situations in particular, requiring no guide tracks and the like which may fill with debris, thereby hindering operation. Further, the present apparatus can be attached to a single gate-mounting post, is resistant to the elements, and requires no latching means for the distal end of the gate to retain same in closed position.

Thus, in one preferred form of the invention, gate operating apparatus for a swinging gate suitably hinged or journalled on a gatepost for swinging movement between open and closed positions comprises a weight for connection through a cable and pulley arrangement to the gate for moving the gate between the open and closed positions in one direction by gravity fall of the weight, and an electrically controlled winch and cable system for connection to the gate, for pulling the gate between the open and closed positions in the opposite direction, thereby raising the weight, with control means for the winch including means for braking the winch when the gate is closed so as to hold the weight in elevated position and for releasing the winch when the gate is to be opened, allowing the weight to fall and open the gate. The winch may, for example, be operated by a battery controlled electric motor of the type which is braked when power supply thereto is termininated, and the motor operating circuit may incorporate a radio signal receiving means whereby the apparatus may be operated remotely by a suitable radio transmitter. Limit switches may be associated with the gate for terminating the power supply when the gate has been moved into open and closed positions.

The apparatus can suitably be attached to the gatepost, which itself may conveniently be bolted to a mount supported in a suitable foundation. The system is simple to install yet rugged and reliable in operation, and requires no latching means for the distal end of the gate.

In a modification of the invention, the weight and cable arrangement with motor-driven winch may be replaced by a reversible linear electrical actuator, such as a screw jack, the actuator motor being pivotally carried on an arm mounted on the gatepost, and the jack nut being pivotally mounted on the gate itself, so that operation of the motor in one direction is effective to open the gate and reverse operation of the motor is effective to close the gate. Limit switches may again be employed to terminate motor operation when the gate is open or closed, and the motor may again be battery controlled through radio-transmitted signals.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
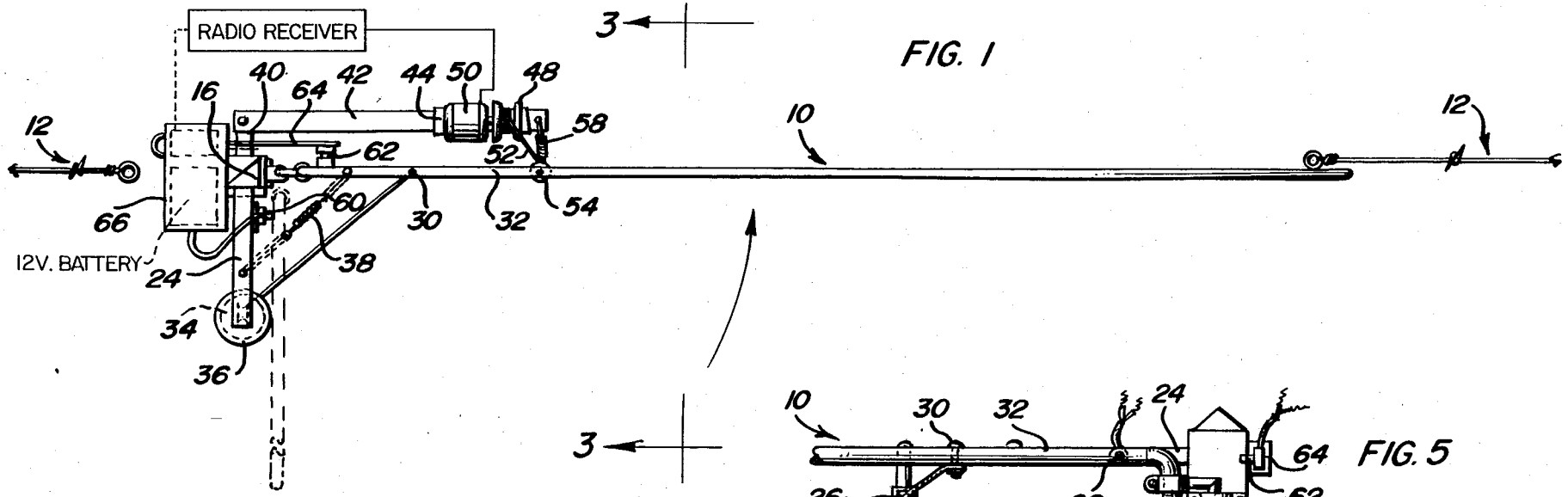
FIG. 1 is a plan view of a farm gate equipped with gate operating apparatus in accordance with the invention, the gate being shown in closed position.

Referring initially to FIGS. 1–6, there is illustrated a swinging gate 10 which may, for example, comprise a farm or ranch gate for closing an access opening in a fence 12. The gate may, for example, be hinged on pillow block bearings 14 or the like on a gatepost 16 (which may comprise a length of box-section steel plate) having a flange connection 18 with a mounting post 20 embedded in a concrete foundation 22 or the like. Gatepost 16 carries operating apparatus in accordance with the invention for powered opening and closing of the gate as will be described below. The gate is adapted to swing between a closed position (FIGS. 1–4) and an open position (FIGS. 5 and 6) substantially perpendicular to the closed position.

Figure 5:
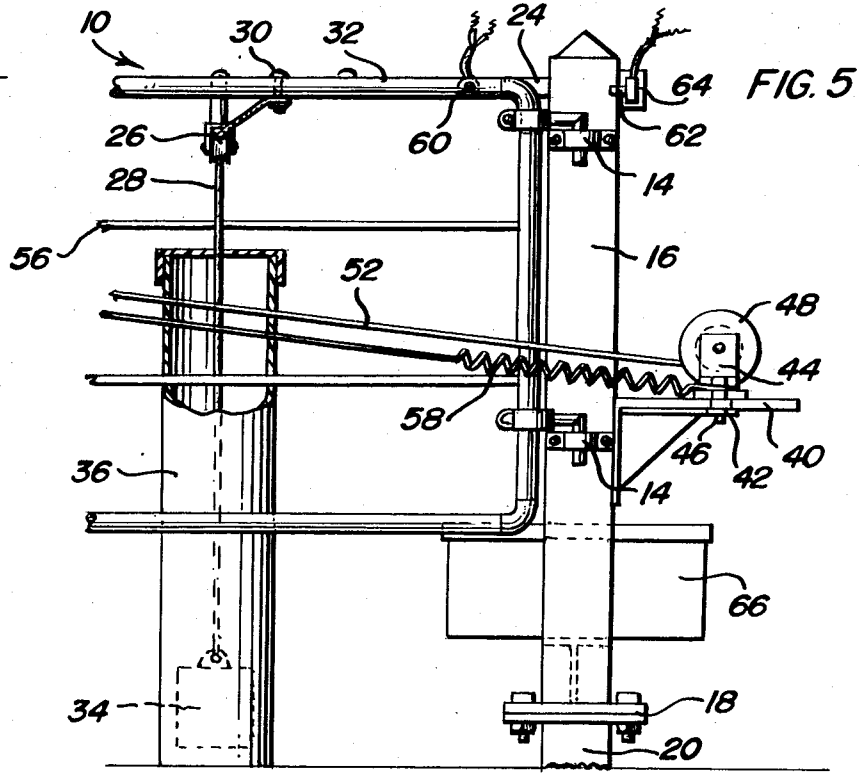
FIG. 5 is a view similar to FIG. 3 but showing the gate in open position.
Figure 6:
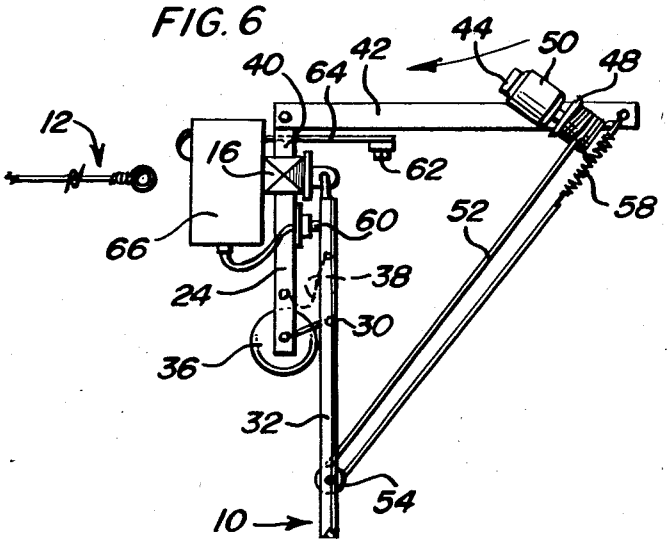
FIG. 6 is a view similar to FIG. 1 showing the gate in open position.
Figure 2:
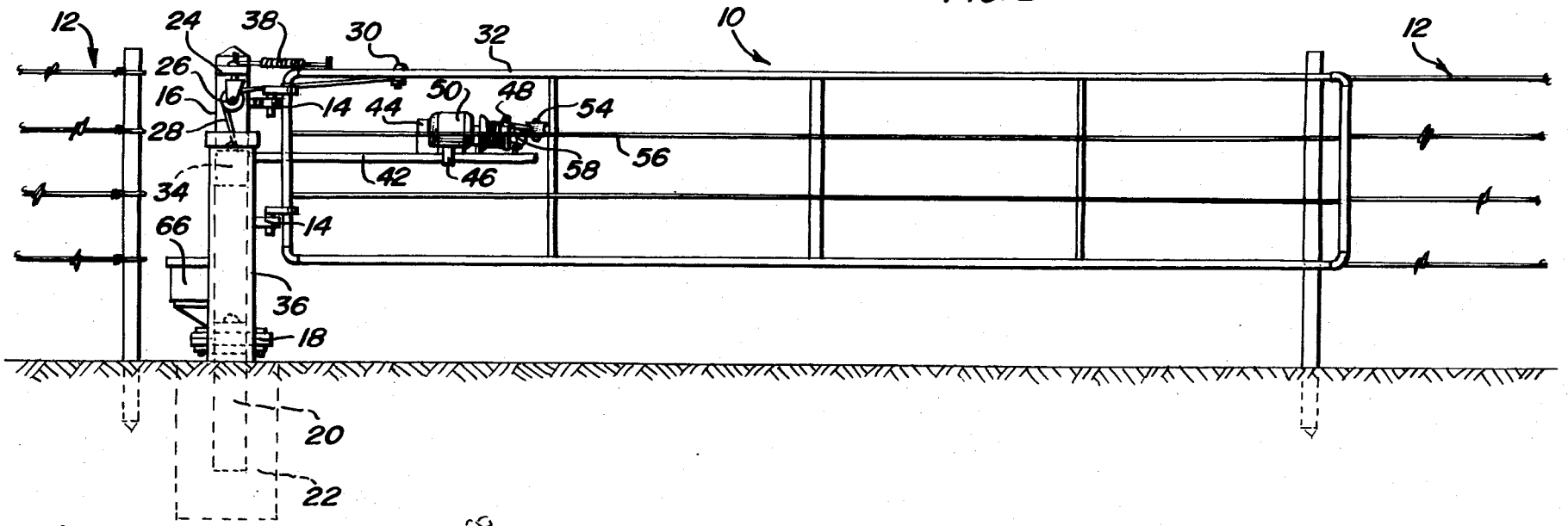
FIG. 2 is an elevational view of the gate as shown in FIG. 1.

The gate operating apparatus includes a first support arm 24 extending from near the top of post 16 substantially in parallel with the position of the gate when open, arm 24 being provided with a pulley 26, over which is passed a steel cable 28 having a connection 30 at one end with upper rung 32 of the gate, and being connected at its other end with a gate-opening weight 34. The length of cable 38 and the geometry of its connections is such that when the gate is in closed position (FIG. 3), the weight is in elevated position, and when the weight is allowed to fall and open the gate through 90° (as will be described), the weight drops substantially to ground level (FIG. 5). The weight may be provided with a covering cylinder 36 of plastic or the like to protect it from the elements. Also connected between arm 24 and the upper run 32 of the gate is a tension spring 38 for providing a gate opening force assisting weight 34 in initiating opening of the gate.

Opposite arm 24, gatepost 16 carries a bracket 40 for a second support arm 42 extending substantial in parallel with the gate when closed A bracket 44 is mounted on arm 42 by means of a pivot pin 46, the bracket carrying a winch drum 48 and an electric drive motor 50 for the winch drum. A cable 52 extends from the winch drum over a pulley 54 on an intermediate rung 56 of gate 10, and the free end of the cable is connected to a return spring 58 attached to arm 42. Motor 50 may be of the reversible type, and the winch and motor assembly may incorporate a self-locking electrical brake mechanism, known per se, for locking the winch drum against rotation except when power is supplied to operate the motor. Thus, when the gate is closed, cable 52 is reeled in on winch drum 48 and without power being supplied to the motor, the winch drum will be locked, retaining the gate in closed position without the need for a latch at its distal end, and holding weight 34 in the elevated position. When, however, power is supplied to the motor 50 to operate the winch in a direction for paying out cable 52, the brake is released, allowing weight 34 to fall under gravity and open the gate, assisted by spring 38.

A first limit switch 60 may be provided on arm 24 to be contacted by gate 10 in open position, terminating the power supplied to the motor 50 thereby again locking the winch and holding the gate in open position. Then, to close the gate, power is supplied to motor 50 to operate winch 48 in a direction reeling in cable 52 and elevating weight 34. A second limit switch 62 is provided on an arm 64 extending from post 16 to be engaged by the gate in closed position again terminating the supply of power to motor 50 and locking the winch as previously. It will be understood that pivot pin 46 allows the winch and motor to swivel during opening and closing of the gate to keep cable 52 in alignment with the winch and pulley 54.

Motor 50 may be a DC motor operated, for example, from a 12 volt battery contained along with other control circuitry in a control box 66 which may also be suitably carried on post 16. The control circuitry may include a radio receiver for operating the motor either to open or close the gate, responsive to receipt of a relevant signal from a suitable radio transmitter, for example, of the type used for controlling model aircraft and the like, or used in connection with garage door openers. The circuitry may also include a manual operating switch located on or adjacent post 16, so that the gate can also be operated in situ without the radio controller.

The electrical control components of the gate operating apparatus may all be of a standard readily available type, and will not therefore be described herein in detail, since the invention is more particularly concerned with the mechanical aspects and configuration of the operating apparatus.

Figure 8:
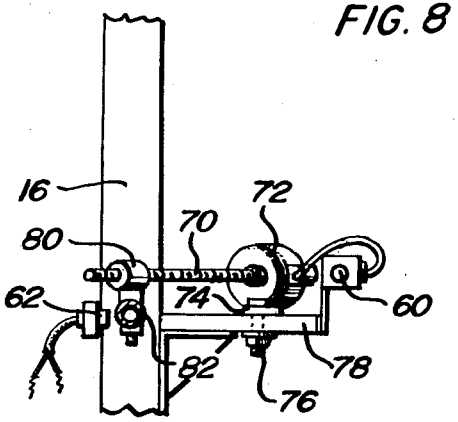
FIG. 8 is an elevational view of the apparatus shown in FIG. 7.
Figure 7:
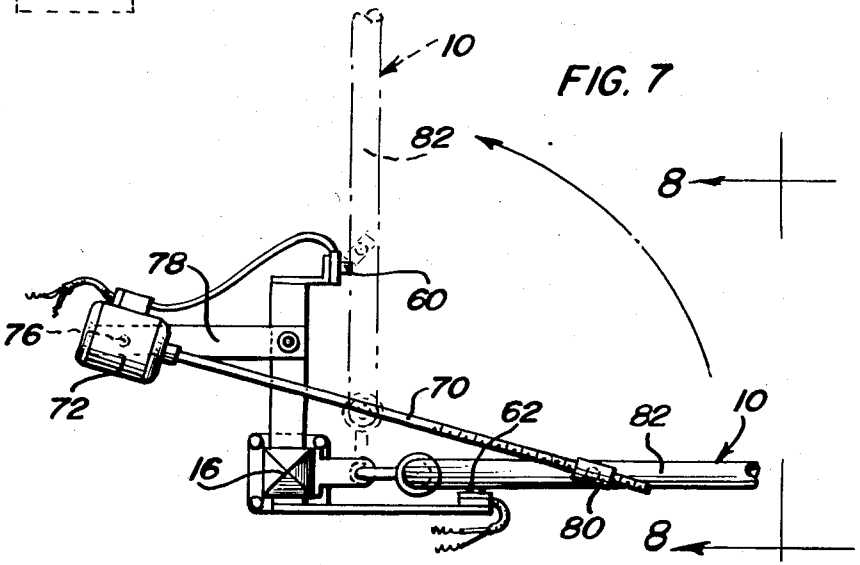
FIG. 7 is a plan view of a part of the gate showing a modified form of gate operating apparatus in accordance with the invention.
Figure 4:
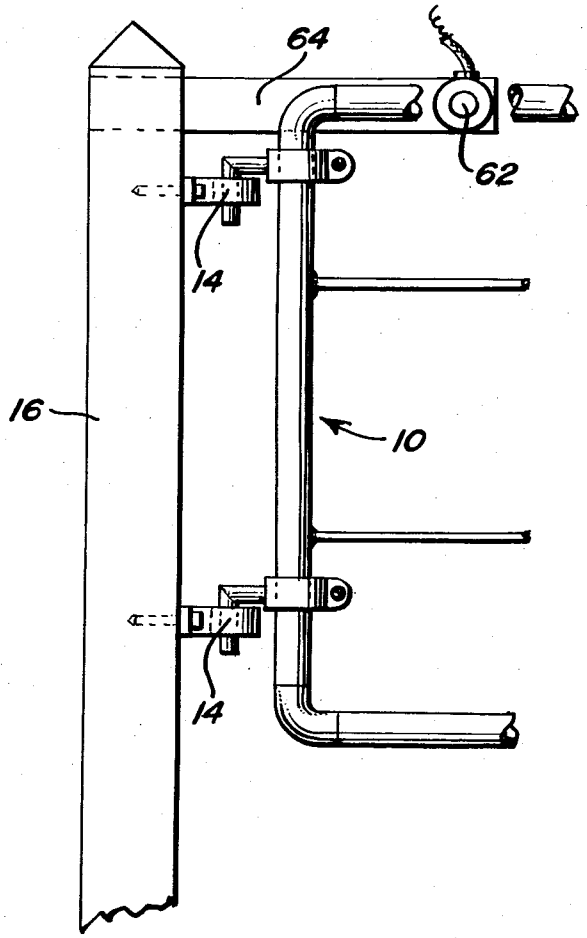
FIG. 4 is an enlarged elevational view of a part of the gate.
Figure 3:
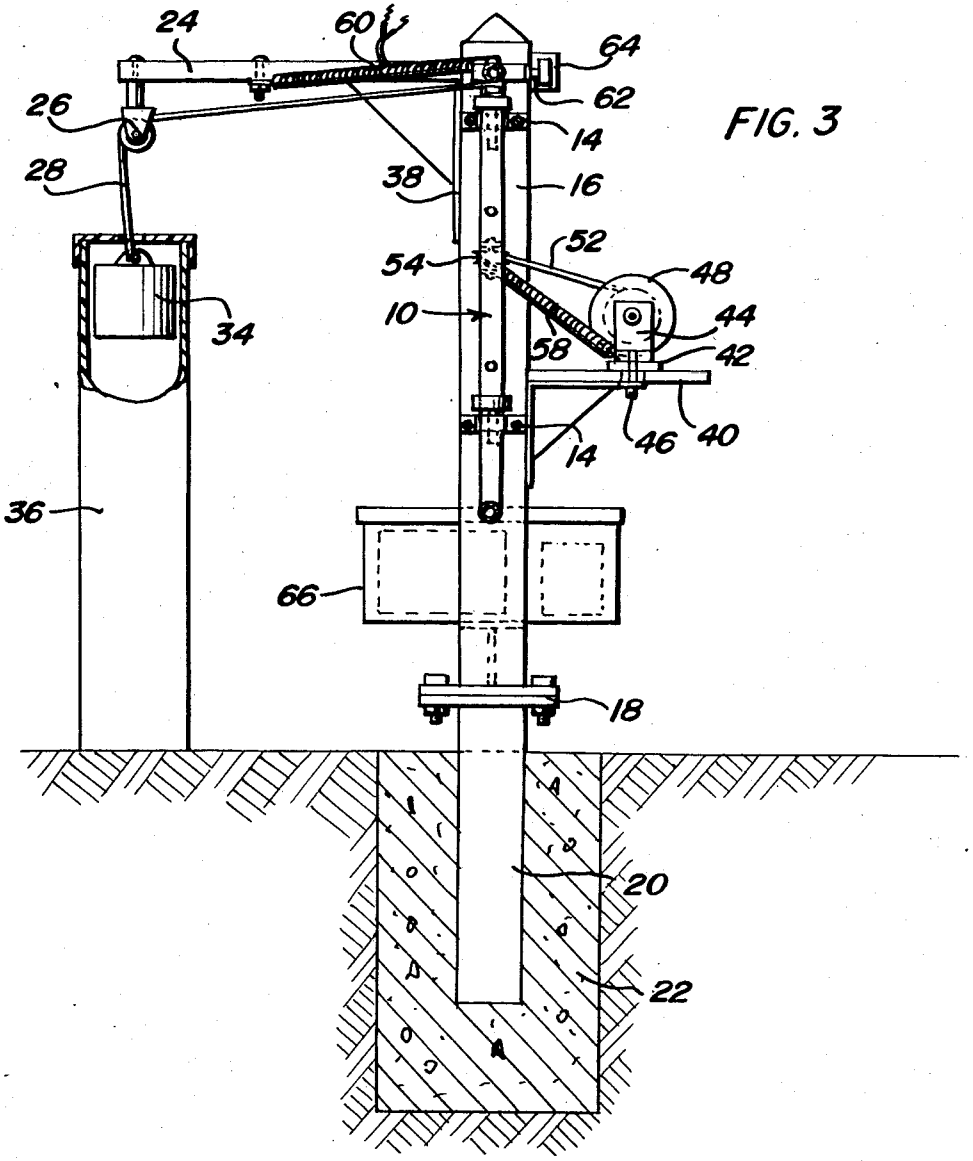
FIG. 3 is an enlarged sectional view on section line 3—3 of FIG. 1.

A modified form of gate operating apparatus in accordance with the invention is shown in FIGS. 7 and 8. In this case, the winch and weight system of the previous embodiment is replaced by a reversible linear electrical actuator in the form of a screw jack, comprising an elongate rotary screw 70 connected with the output shaft of a reversible DC motor 72 pivotably mounted by a bracket 74 and a pivot pin 76 on an arm 78 supported from gatepost 16, with screw 70 engaging a nut 80 pivotally carried on rung 82 of gate 10, so that rotation of the screw in opposite directions is effective to open and close the gate respectively. Like electrical controls, including the opening and closing limit switches 60 and 62 may be provided for motor 72 as in the previous embodiment.

In another (non-illustrated) modification of the original embodiment, the gate closing weight may be replaced by a second motor-driven winch system similar to the winch and motor assembly previously described, but acting in opposition thereto to provide a gate-opening force in place of weight 34 and spring 36. In a further modification, the motor and winch support arm 42 can be arranged to swing around with gate 10 when it is opened (and spring back to the illustrated position prior to closing) in order that the winch and motor arm does not form an obstruction in the gate opening.

In yet a further modification of the apparatus illustrated in FIGS. 1–6, the weight 34 and spring 36 can provide the gate closing force, while the motor 50 and winch 48 provide the gate opening force. In this arrangement, the motor can be employed to reel in cable on winch 48 when it is required to open the gate, thereby raising weight 34. The appropriate limit switch will than lock the motor and winch and when it is required to close the gate, the electrical lock can be released allowing the weight to fall thereby paying cable off the winch drum.

In each embodiment, the gate operating apparatus may be incorporated on the gatepost structure and provides an economical and effective means for operating a swinging gate under remote or direct manual control.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for operating a swinging gate hinged on a gatepost between open and closed positions comprising a weight, means connecting the weight to the gate for providing movement of the gate in one direction between said positions responsive to falling movement of the weight under gravity, and raising of the weight responsive to movement of the gate in the opposite direction, and powered means connected with the gate for moving the gate in said opposite direction between said positions, thereby raising the weight, and for holding the gate in one of said positions with the weight in raised position.

2. The apparatus of claim 1 wherein the powered means comprises an electrically controlled winch and cable means connected between the winch and the gate for moving the gate in said opposite direction by reeling in the cable responsive to operation of an electric winch motor.

3. The invention of claim 2 wherein the winch and drive motor are carried on a bracket including means for pivotally mounting same on an arm extending from the gatepost, and wherein the cable has one end connected to the winch and the other end connected to attachment means on said arm, the cable being adapted to extend from the winch around a pulley on the gate and back to said attachment means, and the winch and motor being adapted to swivel on the arm during movement of the gate to align the cable means and pulley.

4. The invention of claim 3 wherein the attachment means comprises a tension spring.

5. The invention of claim 2 wherein the motor has a control circuit including radio receiver means for operating the motor responsive to receipt of the relevant signal from a radio transmitter, whereby the gate may be opened and closed remotely.

6. The invention of claim 2 wherein the motor has a control circuit for operating the winch to move the gate in the opposite direction responsive to the supply of power to the motor and to hold the gate in one of said positions with the weight in raised position responsive to termination of the supply of power to the motor.

7. The invention of claim 6 including limit switch means positioned to be contacted by the gate when attaining said one of said positions to terminate the supply of power to the motor.

8. The invention of claim 7 including radio receiver means for initiating the supply of power to the motor for operating the winch responsive to receipt of an actuating radio signal.

9. The invention of claim 1 wherein the weight is connected to one end of a cable having its other end connected with the gate, the cable passing around a pulley suspended from a support arm extending from the gatepost.

10. The invention of claim 9 wherein the weight is received for vertical movement in an upright enclosing container.

11. Apparatus for operating a swinging gate hinged on a gatepost between open and closed positions comprising first actuator means in the form of a winch and winch drive motor carried on a support arm extending from the gatepost on one side of the gate, the winch being connected to the gate by a cable for moving the gate in one direction between said positions responsive to operation of the winch effective to reel in the cable, and weight means for moving the gate in the other direction between said positions.

12. The invention of claim 11 wherein the weight means comprises a weight connected to the gate on the other side of the gatepost in a manner whereby the weight is raised when the gate is moved in said one direction and allowed to fall under gravity on release of the first actuator means to move the gate in the other direction.

13. The invention of claim 12 wherein the weight is connected to a cable extending from the gate over a pulley carried on a second support arm attached to the gatepost.

14. The invention of claim 13 including a spring connected between the gate and the second arm for assisting the weight in moving the gate in the other direction upon release of the first actuator means.

15. The invention of claim 12 including means for supply of electric power to the winch motor for operating the winch to reel in the cable, and means for terminating said supply of power to the motor when the gate attains one of said positions, termination in the supply of power to the motor being effective to lock the winch and hold the weight in raised position.

* * * * *